US006594970B1

(12) United States Patent
Hyne et al.

(10) Patent No.: US 6,594,970 B1
(45) Date of Patent: Jul. 22, 2003

(54) METHOD AND APPARATUS FOR WRAPPING PALLETIZED BUNDLES

(75) Inventors: Jeremy D. Hyne, Miami Beach, FL (US); Jeffrey A. Bond, Plantation, FL (US)

(73) Assignee: Quipp Systems, Inc., Miami, FL (US)

( * ) Notice: Subject to any disclaimer, the term of this patent is extended or adjusted under 35 U.S.C. 154(b) by 72 days.

(21) Appl. No.: 09/590,102

(22) Filed: Jun. 8, 2000

Related U.S. Application Data

(60) Provisional application No. 60/138,459, filed on Jun. 10, 1999.

(51) Int. Cl.[7] ..... B65B 13/02
(52) U.S. Cl. ..... 53/399; 53/447; 53/588
(58) Field of Search ..... 53/447, 399, 540, 53/588, 255, 260, 575, 556

(56) References Cited

U.S. PATENT DOCUMENTS

| | | | | |
|---|---|---|---|---|
| 3,990,572 A | | 11/1976 | Fishback | |
| 4,271,657 A | * | 6/1981 | Lancaster et al. | 53/138.4 |
| 4,439,084 A | | 3/1984 | Werkheiser | |
| 4,454,705 A | * | 6/1984 | Benno | 53/399 |
| 4,546,593 A | * | 10/1985 | Lasscock | 414/788.9 |
| 4,553,374 A | * | 11/1985 | Lancaster et al. | 53/465 |
| 4,593,517 A | | 6/1986 | Mattila | |
| 4,607,476 A | | 8/1986 | Fulton, Jr. | |
| 4,730,436 A | * | 3/1988 | Angelino | 53/170 |
| 4,747,252 A | | 5/1988 | Kapke | |
| 4,843,797 A | | 7/1989 | Butterly, Jr. et al. | |
| 4,995,224 A | | 2/1991 | Yourgalite et al. | |
| 5,005,335 A | | 4/1991 | Yourgalite et al. | |
| 5,046,303 A | | 9/1991 | Becicka et al. | |
| 5,090,177 A | | 2/1992 | Gombos et al. | |
| 5,111,931 A | | 5/1992 | Gombos et al. | |
| 5,203,671 A | * | 4/1993 | Cawley et al. | 414/791.6 |
| 5,343,670 A | * | 9/1994 | Gombos et al. | 53/399 |
| 5,566,530 A | | 10/1996 | Johnstone et al. | |
| 5,623,808 A | | 4/1997 | Franklin et al. | |
| 5,701,722 A | | 12/1997 | Franklin et al. | |
| 5,893,258 A | * | 4/1999 | Lancaster, III | 414/907 |
| 6,161,365 A | * | 12/2000 | Girard et al. | 53/441 |
| 6,402,455 B1 | * | 6/2002 | Vincent et al. | 414/789.5 |

FOREIGN PATENT DOCUMENTS

DE 3431628 A1 * 8/1984 ..... B65B/11/02

* cited by examiner

*Primary Examiner*—Rinaldi I. Rada
*Assistant Examiner*—Louis Tran
(74) *Attorney, Agent, or Firm*—Volpe and Koenig, P.C.

(57) ABSTRACT

A method and apparatus for wrapping a loop of film about a pallet, which supports a layer of products, and a guide, through which said layer passes, to prevent crushing and/or displacement of the product layer. Subsequent product layers are similarly protected by looping film about a previous loop of film and said guide. The guide is designed to facilitate removal of the film looped thereabout as the product layers are lowered.

21 Claims, 9 Drawing Sheets

METHOD AND APPARATUS FOR WRAPPING PALLETIZED BUNDLES

This application claims the benefit of provisional application Ser. No. 60/138,459 filed Jun. 10, 1999.

FIELD OF THE INVENTION

The present invention relates to palletizers and to wrapping articles stacked on palletizers and more particularly, to a novel method and apparatus for wrapping articles on pallets in such a manner as to prevent the items being wrapped from either being crushed or from shifting their position and using less expensive and less complicated equipment than that used in conventional systems.

BACKGROUND OF THE INVENTION

Conventional materials handling techniques incorporate the use of pallets, which are typically moved about, with or without loads, by forklift trucks and the like. These techniques have been proven to be effective from the point of view of both cost and efficiency. In order to stabilize loads placed on pallets and especially loads having shapes which deviate from shapes which easily stack and retain their stability, such as cardboard cartons and the like, it is necessary to use a wrapping film, which is wrapped about the perimeter of the load.

For example, it is conventional to successively load layers of items upon a pallet and to wrap the layers of items, assembled on the pallet, with a stretch film to thereby stabilize the completed load for subsequent transportation and handling.

As each layer is placed upon a pallet, the wrapping film, which is typically a stretch film, is stretched as it is wrapped around each completed layer deposited on the pallet.

Typically, since the wrapping film is stretched during application, some or all of the forces required to stretch the film are transferred to the products being wrapped on the pallet. This force disturbs the products and especially their positioning, resulting in a poorly wrapped pallet load. The forces exerted upon the products loaded upon the pallet may even crush the products in the event that they are capable of being crushed and/or may displace the articles or products from the desired position that they were originally placed upon the pallet, which shifting of position affects both the stability and integrity of the wrapped load, and often results in products being crushed and/or falling off of the loaded pallet.

One technique, which has partially solved the above problems, is the utilization of a powered stretch wrap applicator head, which includes a means for driving the film at a speed or speeds that are independent from the wrapping cycle, thereby reducing the force imparted to the products being wrapped. This technique necessitates the use of a motor-driven, film pre-stretching roller assembly and a cooperating sensing device mounted to move along a circular track in order to properly wrap the film about the load, which is expensive and also necessitates significantly more rugged structural members to support this assembly.

In addition, when wrapping loads on a pallet comprised of unstable and/or irregularly shaped products, the wrapping problem is compounded in two ways: 1) each layer of products that is placed on a pallet in a predetermined, desired array, can become disoriented and displaced by a previously applied layer of products due to the effect of the irregular shapes of the products; and 2) the irregular shapes of the products cause the stretched film material to collapse into the spaces between layers of products, which results in unevenly wrapped, loaded pallets and requires additional wraps of stretch film to stabilize the load thereby increasing both the cost and the cycle time of loading a pallet, leading to a significant reduction in the efficiency of the pallet loading operation. This problem is quite prevalent in the loading and wrapping of newspaper bundles and especially, those having a number of different shaped inserts, causing the bundles, when wrapped, to assume a shape referred to in the newspaper bulk handling industry as "watermelons" or "footballs".

Although the first-mentioned problem may be resolved, at least partially, by placing a sheet of material (typically referred to as a "tier-sheet") between each layer of products, this operation increases the overall cycle time, as well as the cost of the loading and wrapping operation.

Prior to the advent of the present invention, no suitable solution has been developed for resolving the second-mentioned problem.

BRIEF DESCRIPTION OF THE INVENTION

The above, as well as other problems in conventional palletizing and load wrapping techniques are solved by use of a method and apparatus which is characterized by comprising guides which are arranged along all of the sides of a layer of products, which layers of products are moved downwardly through the aforesaid guides, which guides both define and limit the perimeter of the layer. The guides are generally perpendicular to the top loading surface of a pallet, which layers pass downwardly through the guides as the pallet is successively lowered to receive each layer of products.

As the pallet passes beneath the lower edges of the guides, the layers formed on the pallet are initially contained by the side guides. The guides, together with the stretch wrap and the manner of application, are especially advantageous in retaining a layer of unstable articles, such as "watermelon" and/or "football" shaped articles and the stretch wrap film, being looped about and engaging both the guides and pallet, surrounds and secures the unstable layer as it passes below the lower edges of the guides, thereby preventing the unstable layer from falling off of the pallet.

A wrapping film, preferably, a stretch wrap film, is dispensed from a supply roll and is wrapped about the perimeter of the pallet and the lower portion of the first layer of products, resting on the pallet, the outer sides of which are exposed as the layer of products on the pallet starts to move below the guides, together with the lowering of the pallet relative to the guides.

The initial wrapping of the stretch film about all four sides of the pallet and partially exposed outer sides of the first layer of products resting upon the surface of the pallet, covers these exposed portions, as well as at least a lower portion of the guides, thereby forming a rectangular-shaped tube or loop of stretch wrap material firmly and tightly wrapped about the perimeter of the pallet and the outer surfaces of the guides so that forces that might otherwise be imparted to the products by the wrapping and stretching of the film about the product layer, are predominately imposed upon the pallet and the guides, as opposed to the exposed portion of the product being wrapped, which prevents the stretch film from displacing and/or crushing the products in the layer being wrapped.

As the first layer of product is wrapped by the stretch film, each successive new layer is assembled above the pallet and placed on previously formed layers. The pallet and successive layers placed thereon, continue to move downwardly relative to the side guides as the pallet is typically lowered so that there becomes a time at which the assembled layers are fully exposed below the side guides.

Each rectangular-shaped tubular portion or loop of stretch wrap film wrapped about the load and positioned between the pallet and the outer surfaces of the guides, serves to hold each product layer in place, preventing each wrapped layer from falling off of the pallet being loaded.

During subsequent wrapping cycles, as each completed loop of stretch film wraps about an upper portion of a previously wrapped layer, the top portion of the film continues to be wrapped about the outer surfaces of the guides, with the result that the film wrapping forces on each newly wrapped layer is minimized and the problem of the film collapsing into the spaces between the regularly shaped products is eliminated or significantly reduced.

The aforementioned upper portion of the stretch film, which is wrapped about the guides, applies a force to the guides and is hence under tension, which may cause the stretch wrap film to retain its grip and/or stick to the guides. These wrapping forces are most prevalent at the corners of the guides. In order to eliminate, or at least, significantly reduce these forces, to enable the loop of shrink wrap film to freely move away from the guides, the guides, in one preferred embodiment of the present invention, include means for periodically creating a film of air between the engaging surfaces of the guides and the loop of stretched film wrapped therearound, enabling the loop of stretch wrap film to move downwardly and away from the guides as the layer of products having the lower portion of the stretch wrap film looped therearound is lowered relative to the guides, enabling the present loop of stretch wrap film to move downwardly in readiness for wrapping the next loop of stretch wrap film, partially about an array of products and partially about the guides. This operation is continued until the final and topmost layer of product is deposited upon the pallet whereupon the terminating loop has its free end secured to the outermost layer of stretch wrap film engaged by the free end.

The aforementioned pallet loading system also includes apparatus for storing empty pallets and delivering stored, empty pallets, one at a time, to a pallet loading station in synchronism with apparatus for receiving, arranging and depositing arrays of products upon a pallet, as well as apparatus for ejecting pallets which have been loaded with product and fully wrapped, to an exit location in readiness for delivery to utilization devices, such as, conveyors, fork-lift trucks and the like, for conveying loaded pallets to loading bays for loading upon trucks or the like.

The shrink wrap film looped about the guides may be released from the guides by alternative embodiments other than the "air film" technique, described above, such as: angling the guides and forming guides of a surface material having a low coefficient of sliding friction.

As was mentioned above, the method and apparatus of the present invention produces a wrapped load on a pallet which is stable and will not shift when moved and is not subjected to crushing by the stretch wrap film, all of which is accomplished through the use of apparatus which is simpler in design and use, and is less expensive than conventional power driven apparatus.

OBJECTS OF THE INVENTION

It is therefore one object of the present invention to provide novel method and apparatus for wrapping palletized loads comprised of layers of articles, by employment of guides which retain a layer of unstable articles, such as "watermelon" and/or "football" shaped articles, to prevent such articles from falling and looping stretch wrap film about portions of the guides and the pallet to prevent articles from falling off the pallet as the articles move downwardly below the lowers edges of the guides.

Another object of the present invention is to provide a novel method and apparatus for wrapping arrays of product successively deposited upon a pallet by wrapping the perimeter of an array of products together with guides through which the arrays descend to prevent the wrapping material from damaging or displacing the arrays and further to prevent the wrapping film from collapsing into the regions between successive layers.

Still another object of the present invention is to provide a novel method and apparatus for wrapping layers of products deposited upon a pallet or the like in which the wrapping material, typically, a shrink wrap film, is wrapped about both the perimeter of the arrays and guides through which the arrays descend and further for providing techniques for releasing the film wrapped about the guides from the guides to assure smooth continuous wrapping of the layers of products.

Still another object of the present invention is to provide a novel method and apparatus for wrapping film about arrays of products deposited upon a pallet or the like, which prevents collapsing of the wrapped loops of the wrapping film and which further eliminates the need for applying multiple loops of wrapping film in regions the film would otherwise collapse into the recesses between adjacent arrays, but for the novel method and apparatus of the present invention and further in which the wrapping method and apparatus are integrated into an overall system which automates the delivery of empty pallets, delivery of products and arranging products into arrays and depositing arrays upon an empty pallet or upon an array of products previously delivered to the pallet, all of which are performed in an automated and synchronized fashion.

BRIEF DESCRIPTION OF THE FIGURES

The above, as well as other objects of the present invention will become apparent when reading the accompanying description and drawings in which.

DETAILED DESCRIPTION OF THE INVENTION AND PREFERRED EMBODIMENTS THEREOF

Figure 1:
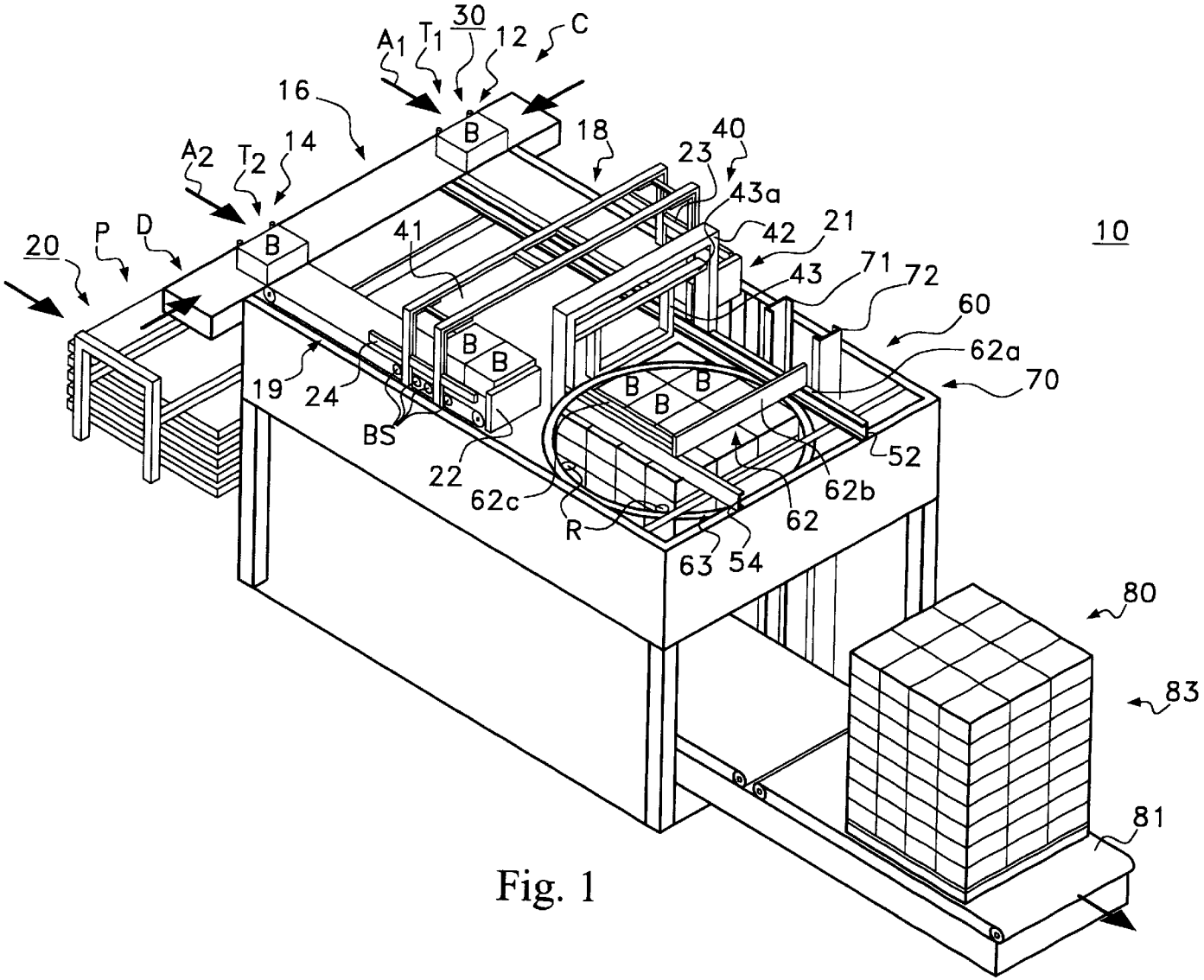
FIG. 1 is a perspective view showing the product palletizer/wrapping embodying the principles of the present invention.
Figure 1A:
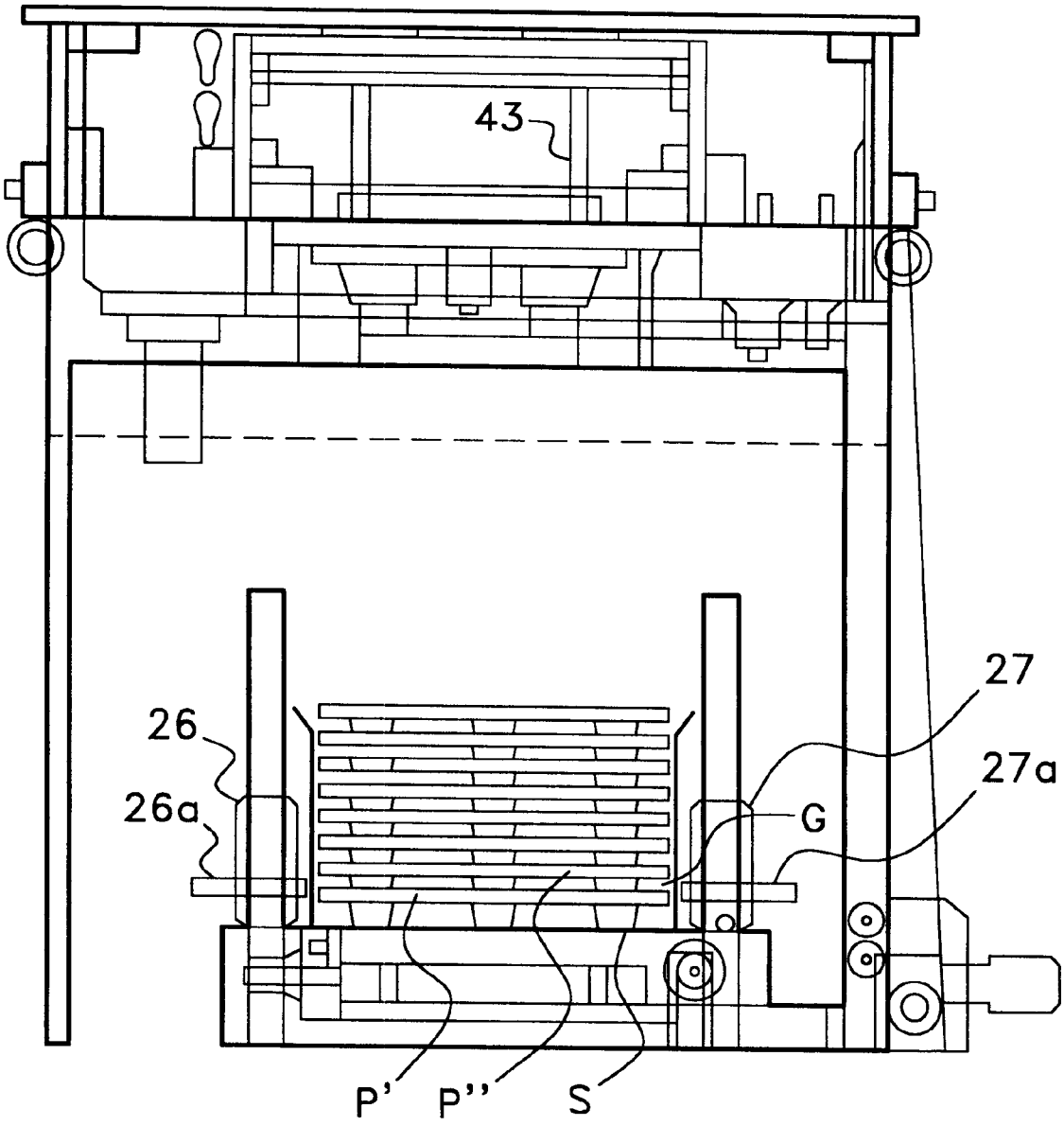
FIGS. 1*a* and 1*b*, respectively, show end and side views of the apparatus of FIG. 1.
Figure 1B:
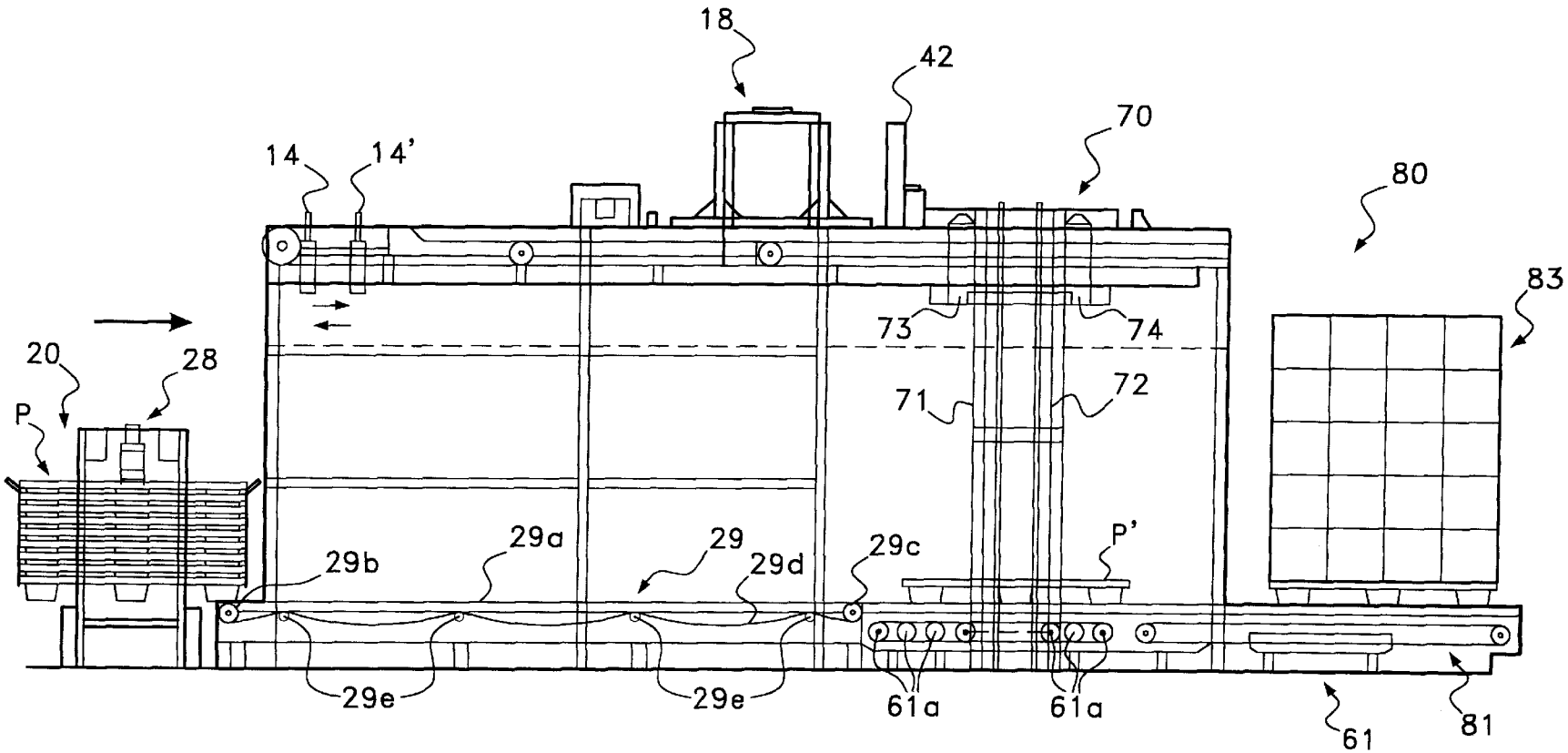

Making reference to FIGS. 1, 1*a* and 1*b*, there is shown therein an automated palletizer/wrapper system 10 for receiving products B, which, for example, may be newspaper bundles, comprised of newspapers that have been stacked, counted and wrapped (or tied) by equipment not shown and delivered to the apparatus 10 by one or two conveyors, C and D, shown, only partially, for purposes of simplicity. System 10 stores and delivers pallets P, one at a time, from a storage location 20 to a pallet loading location for wrapping layers of product deposited either upon the pallet or upon a previously deposited layer, and ultimately delivering a fully loaded and wrapped pallet to an output location 80 ready for subsequent handling.

The aforementioned conveyors C and D, only portions of which have been shown in FIG. 1 for purposes of simplicity, each deliver a product B, such as a newspaper bundle, on a one-at-a-time basis to transfer locations T1 and T2. Each of the transfer locations is comprised of a plurality of spaced, parallel rollers and is further provided with a pair of upright pins 12, 14, which extend upwardly between selected ones of the rollers and which, upon delivery of a product thereto, each respectively, push the product delivered thereto in the directions shown by the arrows A1, A2. The transfer assemblies T1 and T2 comprise a plurality of spaced parallel rollers whose longitudinal axes are parallel to the direction of arrows A1 and A2. The pairs of pins 12 and 14 extend upwardly through selected ones of these rollers and push the products in the direction of the arrows A1 and A2. After pushing a product, the pins return to the start position in readiness for receipt of the next product. In the event that either one of the conveyors C and D is omitted or is not operating, an intermediary conveyor section 16, which is positioned between the transfer stations T1 and T2, serves to deliver product to the transfer station adjacent the absent or inoperative conveyor. For example, let it be assumed that conveyor C is not delivering product. Conveyor D will thus deliver two (2) products, one after the other so as to have the first delivered product deposited on conveyor 16, while the second product to be delivered, which pushes the first product on to conveyor 16, is moved on to transfer station T2.

The intermediary conveyor 16 then conveys the product delivered thereto to the transfer station T2. The operation is substantially similar and is however, performed in the reverse order when conveyor C is utilized to deliver bundles and conveyor D is either not operating or is absent. Alternatively, the products may all be delivered to only one of the transfer stations, whereby all three groups comprised of four products per group, are delivered to the transfer plate from only one of the transfer stations.

The products B moved off of each of the transfer stations T1 and T2 are delivered to driven conveyors 18 and 19 which convey each of the delivered products B in the direction of the arrows A1 and A2 until the product reaches the fixed, stationary stops 21, 22.

As soon as each of the conveyor pairs 18 and 19 have accumulated four products B, sensed by bundle sensors BS, pushers 23 and 24 each push the four products on their associated conveyors 18 and 19 toward one another and on to a transfer plate 41. When one of the conveyors 18 or 19 has delivered thereto a third group of four products, the third group of four products is then pushed on to the transfer plate 41, forming an array of up to twelve products arranged in a 4×3 arrangement. It should be understood that the second set of four products pushed on to the transfer plate 41 by one of the pushers 23 or 24 serves to push the previously delivered group of up to four products to the center of the transfer plate 41.

An inverted, channel-shaped supporting frame 42 supports a gate 43 whose upper member 43*a* has its opposite ends swingably mounted to support frame 42.

Gate 43 is swung upwardly to a height sufficient to enable product on the transfer plate 41 to freely move beneath the gate in its upper position as transfer plate 41 is moved from the product loading position to a position immediately above the station 60 at which the 4×3 arrays of product are delivered either to a top surface of an empty pallet or upon a previously delivered layer of an array of products presently being supported by a pallet in the loading and wrapping station 60.

Pallets P stored at station 20, are stacked one upon the other in the manner shown in FIGS. 1, 1*a* and 1*b*. Cylinders 26 and 27 respectively, drive a pair of separation plates 26*a* and 27*a* into a gap G between the top surface of a bottom-most pallet P' and the under surface of the pallet P" stacked thereon, for example. A cylinder 28 is provided to lift the assembly upwardly depositing only the pallet P' on the support surface S.

The operation is as follows: The pallets rest on the upper run 29*a* of conveyor 29. The separation plates are maintained spaced apart. The plates are lifted by an amount sufficient to move the lips into the aforementioned gap G between pallets P' and P". The plates are lifted again to fully separate pallet P' from pallet P", which is delivered by conveyor 29 to the pallet loading station 60. The plates are then lowered and moved apart, in readiness to separate pallet P" from the next pallet resting upon pallet P"

Pallet P' is moved along the upper run 29*a* of the conveyor 29, which passes about end rollers 29*b* and 29*c* and, since the lower run 29*d* of conveyor 29 is loosely maintained, a plurality of idler rollers 29*e* limits the amount of droop in the lower run 29*d* of conveyor 29. A motor (not shown for purposes of simplicity) is coupled to the upstream end roller 29*c* to "pull" the upper run 29*a* of the conveyor 29 to the right, thus simultaneously "pulling" a pallet delivered thereto, to the right, as shown in FIG. 1*b*.

The pallet P' delivered to the upper run 29*a* of conveyor 29 is then delivered to a roller conveyor 61 positioned at the lower end of station 60. Roller conveyor 61 is comprised of a plurality of rollers 61*a* arranged in spaced parallel fashion. An elevator assembly 70 is provided with a pair of horizontally aligned tines 73, 74 arranged to respectively, move upwardly and downwardly in a vertical direction, guided by the vertically aligned tracks 71, 72.

The forks 73, 74 freely pass through gaps between selective ones of the rollers 61*a* in roller conveyor 61 so as to pass beneath the roller conveyor 61. Thereafter, once a pallet P' is delivered to the roller conveyor 61, elevator 70 is lifted to move the tines upwardly through gaps in the roller array 69 to lift pallet P' to the top-most position just below the transfer plate 41 in readiness for loading.

Transfer plate 41 moves to the right over the empty pallet which has been lifted to the upper-most position. Thereafter, gate 43 swings downwardly. Transfer plate 41 is then retracted, moving to the left relative to FIG. 1, causing gate 43 to "sweep" the products B off the transfer plate and onto the pallet P' which has been lifted to the upper-most position. The frame 62 contains the 4×3 product array to maintain their arrangement and preventing the products from becoming displaced or falling off of the pallet as the array is being transferred from transfer plate 41 to the top surface of the pallet. Sides 62*a*, 62*b* of frame 62 are moveable by cylinders (not shown) to align the 4×3 array. Obviously, any other array of products may be utilized, depending upon the particular application and/or the needs of the user.

A circular ring 63 supports the supply roll of shrink wrap film, to be more fully described, which is operated during the wrapping operation. In one embodiment, the ring is fixed and the supply roll is moved through one complete revolution about track 63, as will be described in greater detail hereinbelow, to wrap one loop of the shrink wrap film about the product, and in the unique manner of the present invention as will likewise be described in greater detail hereinbelow. In another embodiment, the ring 63 is revolvable. Spring-loaded rollers R, fixed to the frame of the apparatus are positioned at spaced intervals about the interior of ring 63. Rollers R' are also provided to engage upper and lower surfaces of ring 63 to maintain the ring 63 in a position to revolve about a center point and to maintain the ring at a given height while enabling the ring to be revolved.

Figure 2:
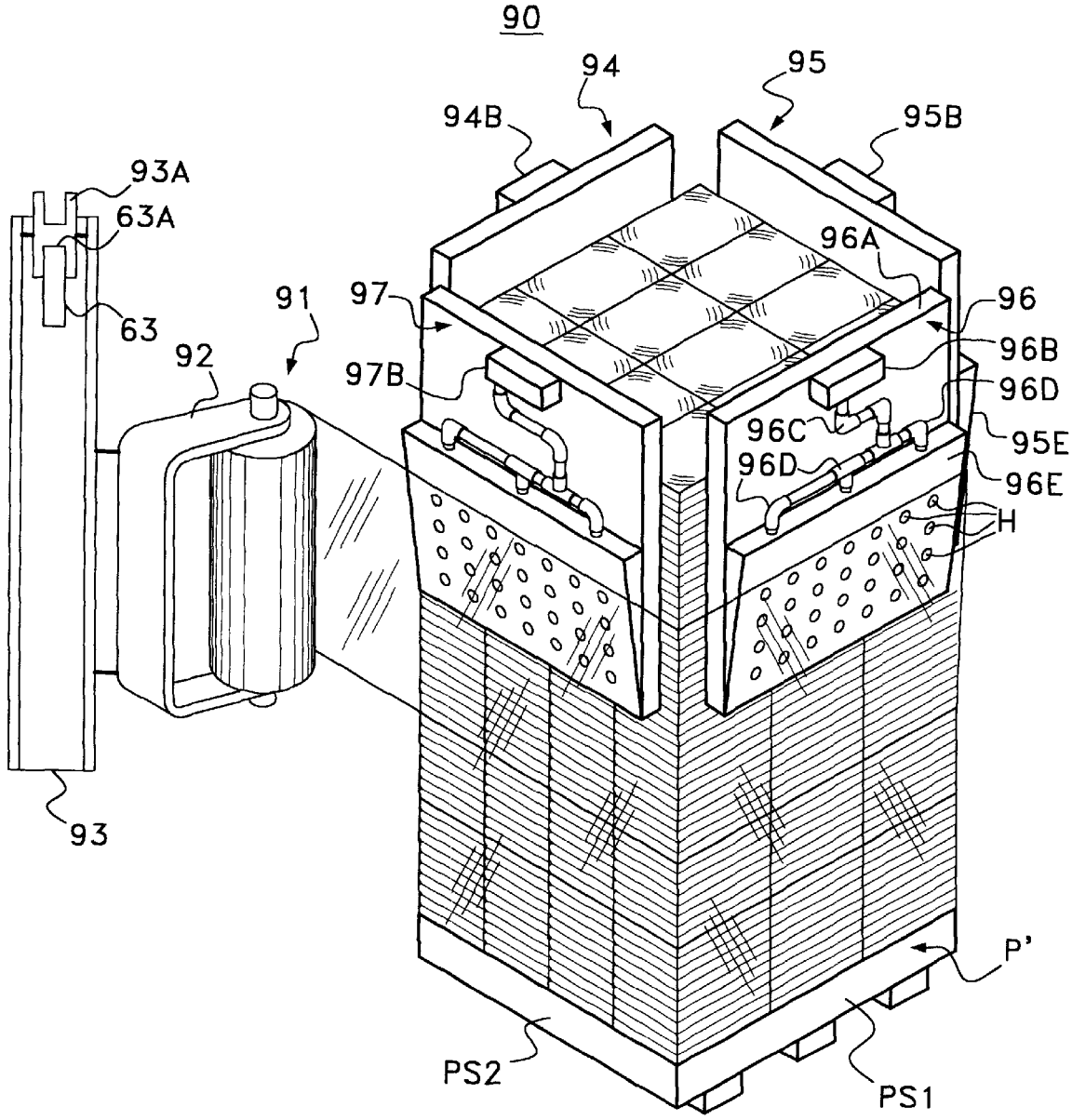
FIG. 2 shows a perspective view of the product wrapping apparatus incorporated into the system of FIG. 1.

A means, such as the gripper 59, shown in FIG. 2 of U.S. Pat. No. 4,593,517 (which is incorporated herein by reference thereto) is provided to hold the free end of the shrink wrap film 91*a* adjacent to the pallet P' and the associated guide until the first loop is complete whereupon, when engagement between the free end of the shrink wrap film and the first loop of the shrink wrap film, which overlaps the free end, is completed, the shrink wrap film "sticks to itself" and is thereby retained in position, as is typical in conventional film wrapping apparatus. Film wrapping begins when at least a portion of the pallet moves below the lower edge of guides 94–97. This can be sensed by a sensor 101 arranged on the elevator (see FIG. 2*b*) to sense when the pallet (or tines 73, 74) pass the sensor as the tines move downwardly. The sensor may be a proximity sensor, optic sensor, or the like.

Figure 1C:
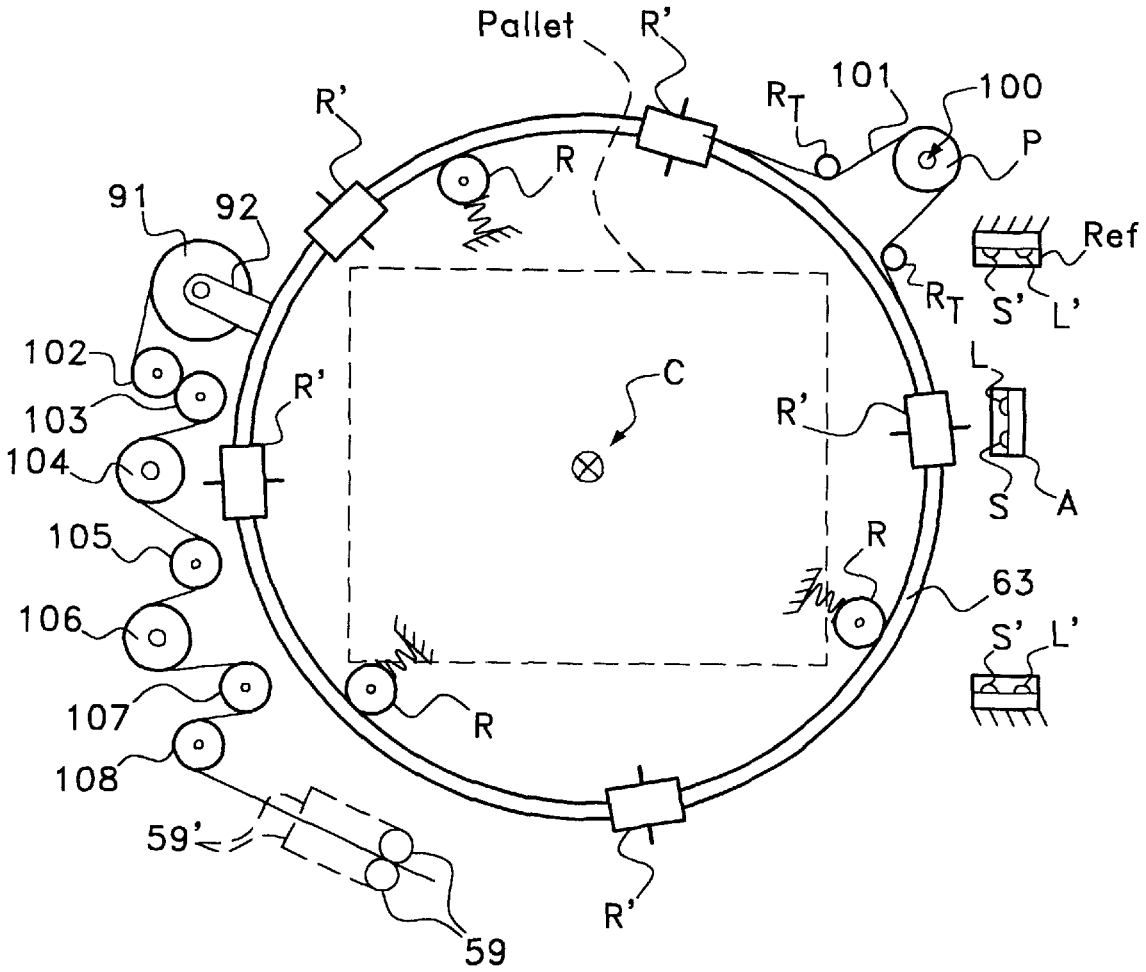
FIG. 1*c* is a top plan view of the pallet wrapping portion of the apparatus of FIG. 1.

FIG. 1*c* is a top plan view showing the revolving ring 63 and the film dispenser in greater detail. Spring-loaded rollers R, mounted to the frame of the loader allow ring 63 to revolve while retaining the revolving ring about an imaginary center C. Pairs of rollers R' are arranged above and below ring 63 to prevent the ring from moving up or down while allowing the ring to revolve about center C, under control of motor 100, which drives a drive belt wrapped about a pulley P attached to motor 100, and ring 63, as well as tension rollers RT.

The dispenser assembly is coupled to ring 63 and revolves therewith. Supply roll 91 is supported on holder 92, which is joined to ring 63. The shrink wrap film is fed about rollers 102 through 108 and extends to gripper 59 which holds the free end of the shrink wrap film, as will be more fully described.

Rollers 104 and 106 are motor-driven at two different rates of rotation to stretch the film as it is unwound. The stretch characteristic of the shrink wrap film is preferably such that the shrink wrap film "plateaus" after a given amount of elongation. The shrink wrap film thus has a slow memory and thereby slowly returns to its normal length.

When placing a new supply roll of film onto the supply roll support, the free end of the film is manually placed between the cooperating arms of the grippers 59, which are vertically aligned at this time. Grippers 59 are closed to grip the film, and, as the film is wrapped about the guide, the grippers swing about a pivot point to move from a "twelve o'clock" position 59 to a "9 o'clock" position 59', while still retaining a grip on the film. The grippers are then spread apart to release the film by the time that the film has been looped once about the pallet and guide.

The opened grippers are rotated from the "nine o'clock" position to the "twelve o'clock" position and are closed to grip the film when the top-most array on the pallet has been wrapped and prior to the heat-cutting of the film, in readiness to wrap the arrays deposited on the next pallet to be loaded.

An angle arm A supports a light source L and a light sensor S, to detect when the shrink wrap film moves past a start position. A reflector Ref cooperates with a light source L' and sensor S' to detect a break in the shrink wrap film to stop the pallet loading operation.

After wrapping one loop of shrink wrap film about the sides of the pallet P' and the lower portions of the guides 94–97, elevator assembly 70 lowers the tines 73, 74 by a distance sufficient to place a top surface of the layer just deposited upon pallet P', just beneath the location occupied by the under surface of transfer plate 41 when it is moved over to the pallet loading and wrapping station 60.

The next array of products which is collected and formed into a 4×3 array in a manner similar to that described hereinabove, is transferred by transfer plate 41 over to the product depositing and wrapping station 60 and, upon appropriate operation of transfer plate 41 and gate 43, as was described hereinabove, the second 4×3 array of products is placed upon the first array previously deposited upon pallet P'. This second layer is then wrapped in a similar fashion to that described briefly hereinabove and these operations are repeated until the pallet P' is fully loaded, whereupon the fully loaded and wrapped pallet is, by activating roller conveyor 61, pushed onto roller conveyor 81 provided at an output station 80 positioned just to the right of the loading and wrapping station 60. The fully loaded and wrapped assembly 83 is then delivered to other output utilization devices. For example: the loaded pallet may be lifted by a fork lift truck for delivery to a truck loading bay; a fully loaded and wrapped pallet may be delivered by a second conveyor adjacent to conveyor 81 to other output utilization means; etc.

Figure 2A:
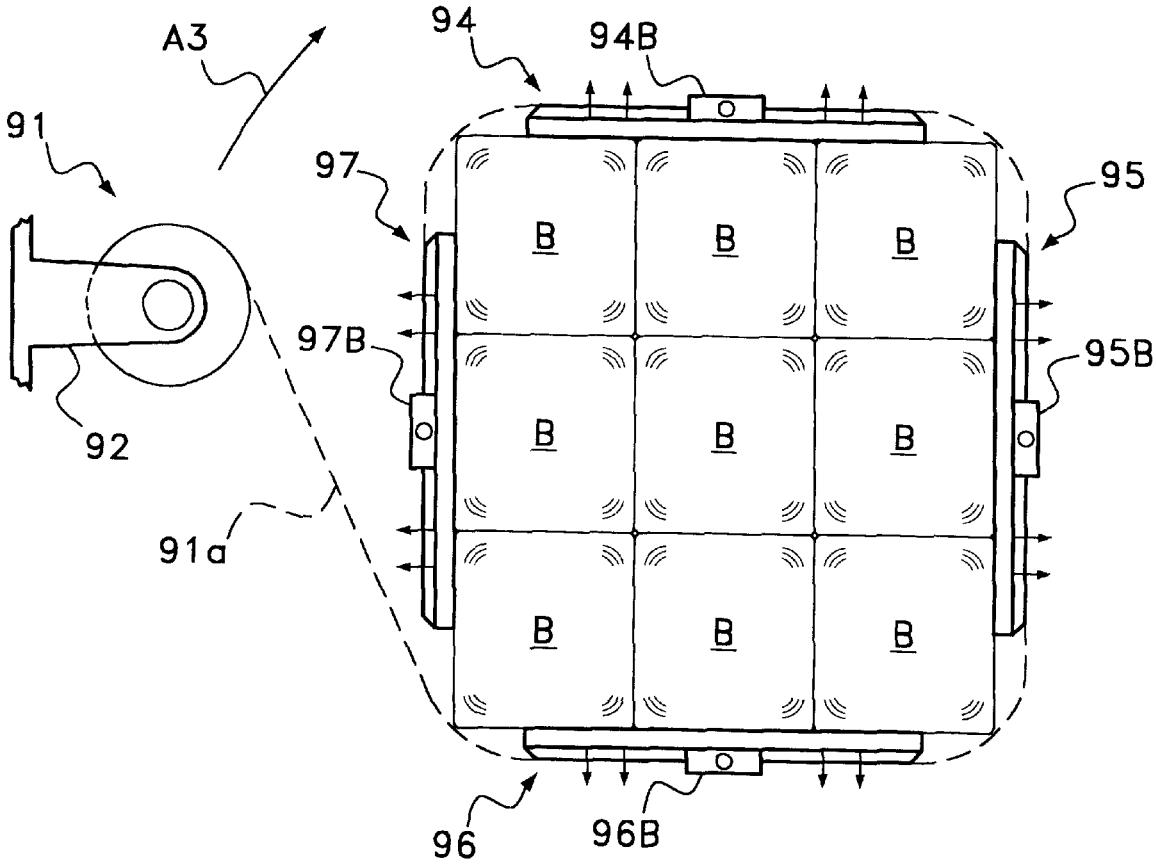
FIGS. 2*a* and 2*b*, respectively, show end and side views of the wrapping apparatus of FIG. 2.
Figure 2B:
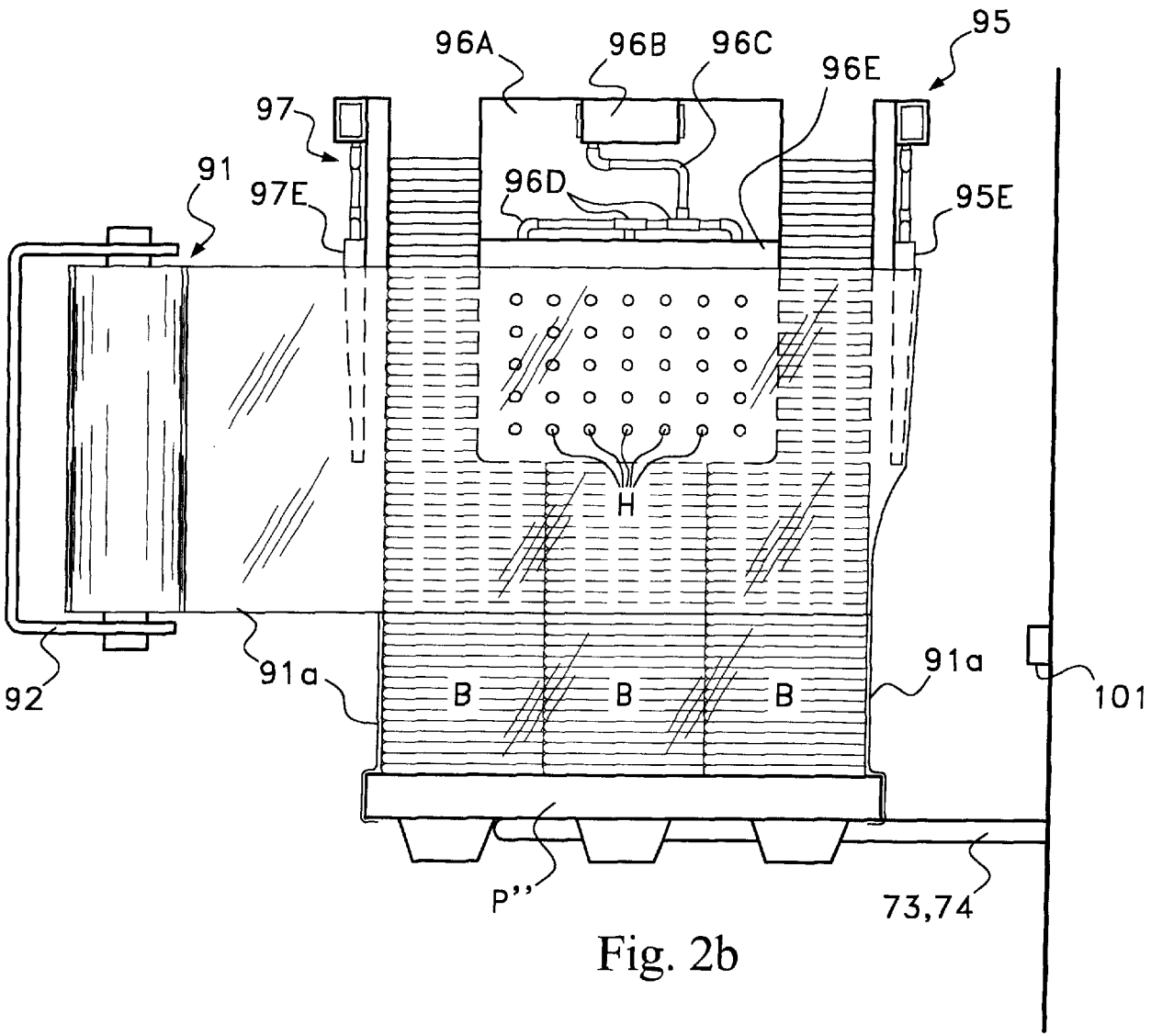

FIGS. 2*a* and 2*b* show further details of the film wrapping assembly for wrapping layers of product delivered to a pallet P'.

The wrapping assembly 90 includes, as was mentioned hereinabove, a supply roll 91 of stretch wrap film which is rotatably mounted upon a supporting bracket 92 which, in turn, is mounted to a supporting member 93 provided with one or more rollers 93*a* which, in one embodiment, rollingly engage and thus roll along the top surface 63*a* of a stationary track 63. A motor, not shown for purposes of simplicity, moves the supply roll about track 63 in the direction shown by arrow A3 (by driving the roller (or rollers) 93*a*), to wrap loops of the shrink wrap film 91*a* about each layer of products. In another embodiment, shown in FIG. 1*c*, the ring 63 revolves under control of motor 100 which drives a belt 101 surrounding ring 63. The roll of shrink wrap is coupled to the ring and revolves with ring 63.

Assuming that the first layer of an array of products has been delivered to pallet P', the pallet P' is lowered by the elevator assembly 70 by an amount sufficient to move the top surface of the previous layer just beneath the transfer plate 41. Depending upon the height of the arrays, a greater or smaller portion of previously delivered arrays will be exposed beneath the lower edges of the guides. Regardless of how much or how little of the arrays are exposed beneath the lower edges of the guides, the film which has been looped about the guides and pallet (and subsequently the guides and a previously applied loop of film) protects and encloses the arrays as they are supported by the film, thereby assuring that the arrays are securely supported, to prevent products and especially "watermelon" and/or "football" shaped products from becoming dislodged and/or falling off of the pallet.

Figure 2C:
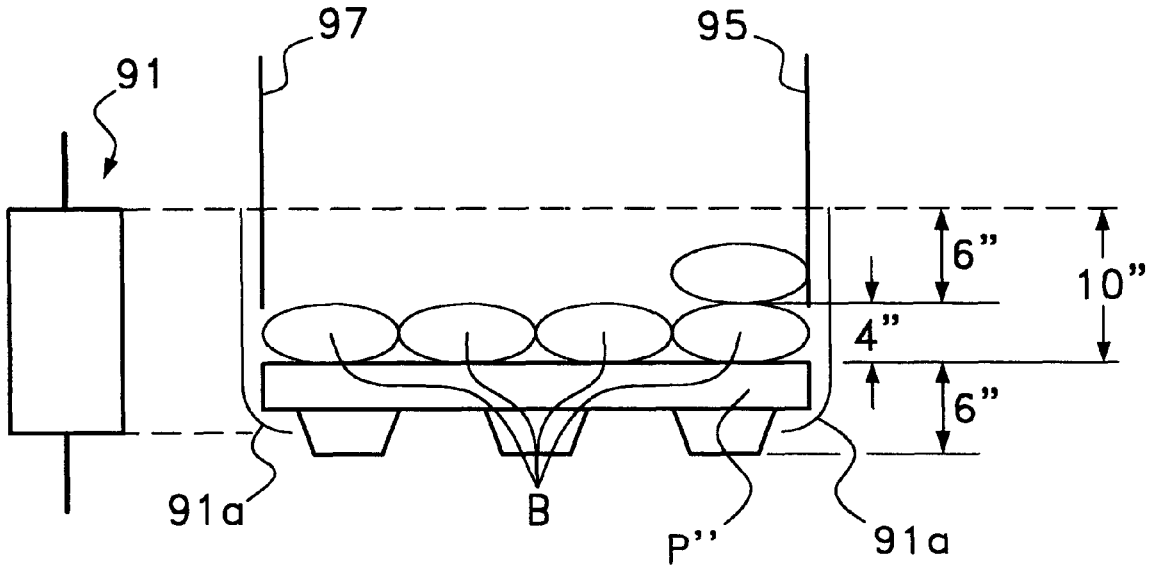
FIG. 2*c* is an elevational view showing the manner in which the stretch film is employed in a conventionally wrapped load collapsed about the load.
Figure 2D:
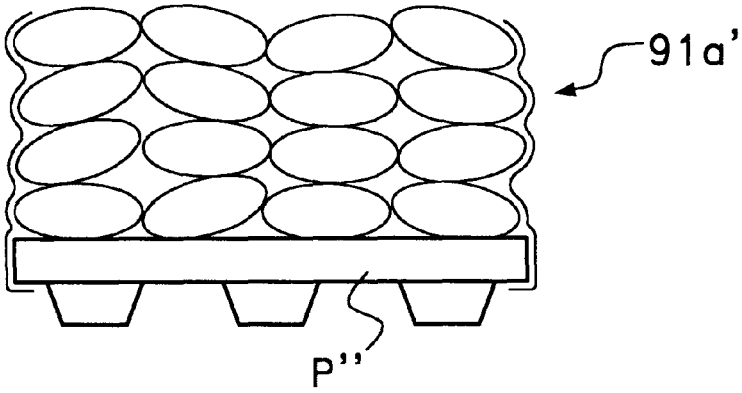
FIG. 2*d* is an elevational view showing a loaded pallet wrapped in a conventional manner.

The supply roll 91 of shrink wrap film 91*a* is of interminate length and has width which, typically, may be of the order of 20 inches. A typical supply roll may have an amount of film sufficient to wrap 50 to 60 palletized loads. However, any suitable capacity of supply roll may be used in the present invention with equal success. When the film 91*a* is stretched, i.e., extended, in the length-wise direction, it narrows as it stretches, typically, to a width of the order of 18 inches. The elevator 70 holds pallet P' in a position so that, as the stretch film supply roll moves about the circular path defined by stationary ring 63, or revolves with revolvable ring 63, the sides of pallet P1 are covered with the bottom portion of film 91*a* and the lower sides of guides 94–97 are wrapped by the film, while the intermediate portion of the film extends across the gap between the lower edges of guides 94–97 and the upper surface of pallet P', which gap is typically of the order of four or so inches. More specifically, in one preferred embodiment, approximately the upper six inches of the film is wrapped around the lower portion of the guides 94–97, approximately the lower eight or so inches of the film 91*a* is wrapped about the pallet (the pallet having a height along the vertical sides of the order of six inches and the shrink wrap film thereby wrapping around the bottom surface of the vertical sides PS1–PS4 of the pallet with the two inch portion of the shrink wrap film at the bottom thereof extending around and under the vertical sides of the pallet). This arrangement, as shown in FIG. 2*c*, thus applies the forces of the stretched film to the guides 94–97 and the sides of the pallet, diverting these forces away from the products B and thus, preventing the film from collapsing and crushing and/or dislodging the products from their desired position as occurs when using conventional wrapping techniques and apparatus. Note FIG. 2*d* wherein the film portion 91*a*' collapses into the space between layers of product when applying conventional techniques and apparatus. It should be noted that FIGS. 2*c* and 2*d* are simplified views of the wrapping station, in which the revolving means, and shrink wrap stretching means have been omitted for purposes of simplicity.

Each of the guides 94–97 is similar in design and function to the other guides and hence only one guide will be described herein in detail, for purposes of simplicity.

Guide 96, for example, is mounted upon a plate 96*a* having a pneumatic valve 96B mounted at the upper end thereof. The pneumatic valve 96B is coupled to a conduit (preferably a flexible tube), not shown for purposes of simplicity, for delivering air under pressure to valve 96B. Valve 96B is opened after a loop of shrink wrap film 91*a* has been wrapped around the four guides 94–97, causing the air under pressure from the air delivery tubing to be delivered through output tubing 96C, which divides into three branch tubes 96D and enters into the interior of a hollow, wedge-shaped housing 96E provided on plate 96. The lower portion of housing 96*d* is provided with an array of holes or openings H. When pneumatic valve 96B is opened, the air under pressure, which is passed through valve 96B, is emitted from the holes H in housing 96E so that, in the event that the shrink wrap film 91*a* tends to stick or grasps onto guide 96, the holes H pass the air under pressure to create a film of air between the outer surface of housing 96E and the adjacent major surface of shrink wrap film 91*a*, causing the shrink wrap film to easily part from the housing 96E as the pallet and array of products deposited thereon is lowered.

It should further be noted that the inclined surface of hollow housing 96E which is aligned to move further away from the loop of shrink wrap film as the pallet P' is lowered, further aids in movement of the shrink wrap film 91*a* away from the guide 96. It should be understood that the remaining guides 94, 95 and 97 operate in a similar manner. More particularly, the pneumatic valves 94B, 95B and 97B, preferably all open simultaneously with the opening of valve 96B to create a film of air between their associated hollow housing and the major surface of the shrink wrap film 91*a* engaging those housings.

Each guide has a height at least equal to the height of an array of products and preferably at least equal to the height of two or more layers of products, dependent upon the products being palletized.

As was mentioned hereinabove, after the next layer of products is deposited upon the first layer, the elevator assembly 70 lowers the pallet P' by the same aforementioned distance as was employed in the first lowering operation, exposing another approximately four inches of product not previously exposed. The supply roll 91 undergoes a second complete revolution, this revolution overlapping the film previously looped about the first layer of bundles has its lower portion overlapping the upper portion of the first loop of film upper and overlapping the lower ends of the guides at its upper end, thus, concentrating substantially all of the forces upon these two aforementioned areas and thereby preventing the central portion of the loop of film from collapsing into the products, thereby preventing displacement and/or crushing of the products.

This operation is repeated until the last layer of products is delivered and wrapped. A "hot wire" which is mounted adjacent to the pallet being loaded is electrically energized to heat and cut through the shrink wrap film when the top most layer has been completely wrapped, as is conventional. One suitable arrangement is shown as the assembly 57 shown in FIG. 2 of U.S. Pat. No. 4,593,517.

Figure 2E:
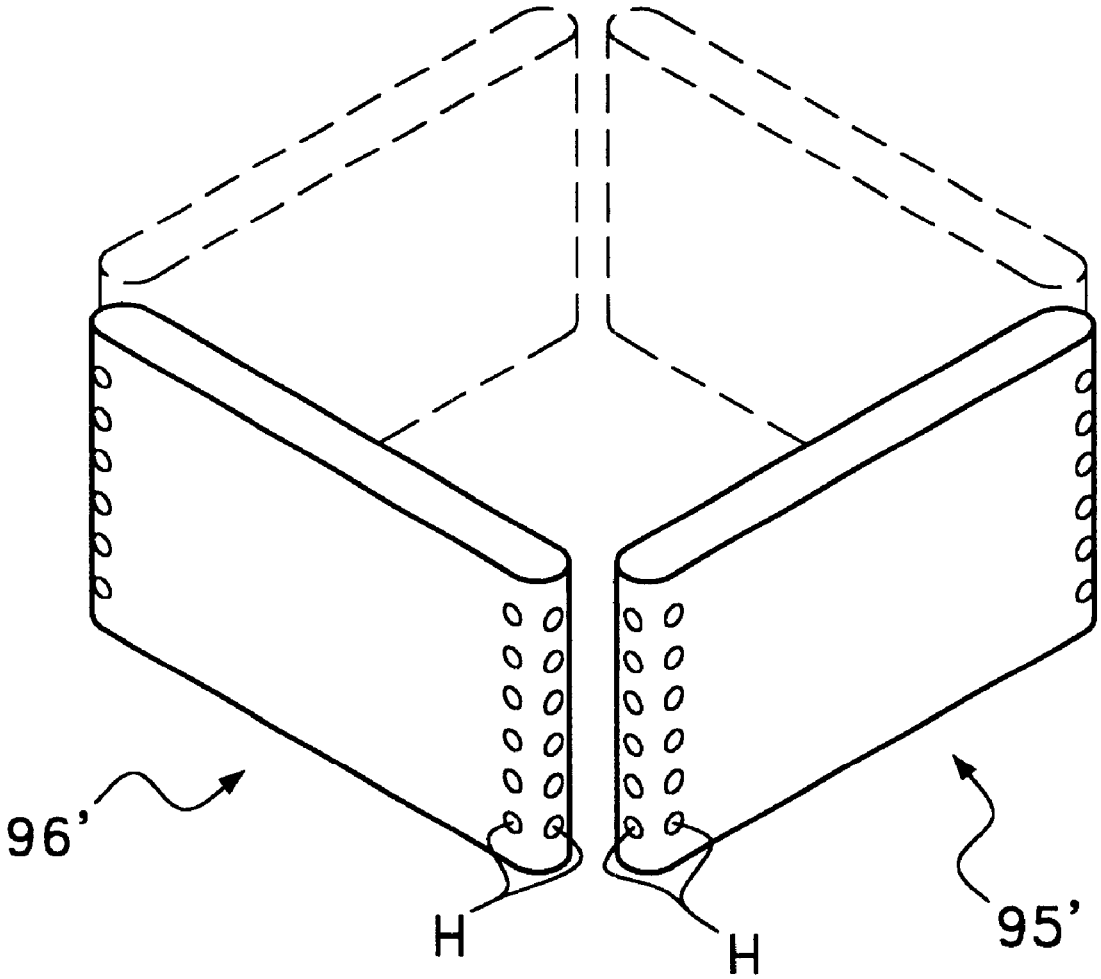
FIG. 2*e* is a perspective view showing another preferred embodiment for releasing shrink wrap film from the guides.

FIG. 2*e* is a perspective view showing two of the four guides provided for supporting the shrink wrap film as bundles are guided through the guide. Sides 95' and 96' are provided with openings H concentrated along the curved edges of the guides. Openings H are arranged in two columns spaced 30 degrees apart. Air under pressure is delivered to the interiors of the guides in a manner similar to that shown in connection with FIG. 2*b*. Since the holding friction between the shrink wrap film and the guides is greatest at the corners, these forces are neutralized by supplying air under pressure through the columns of openings H, enabling the shrink wrap film to move downwardly and off the guides as a pallet is lowered.

It can therefore be seen that the present invention provides a novel pallet loading and wrapping system and especially a novel wrapping system in which the need for supporting and moving a motor and motor-powered stretch rollers upon a guide track has been eliminated and yet which provides a highly efficient and effective method and apparatus for wrapping layers of product on a pallet which prevents the products from being dislodged or disoriented and which prevent the products from being crushed, thereby providing a rugged and stable palletized load which is capable of being handled and transported without fear of collapsing, dislodgment or crushing.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method for securing products deposited upon a pallet for supporting the products and having a perimeter of a given shape, with a film derived from a supply roll, said film having a given width, comprising the steps of:

a) placing an array of products upon a top surface of said pallet to form a first layer of products on said pallet;

b) then moving the pallet a given distance to pass said first layer into a hollow guide having a shape substantially conforming to the shape of the perimeter of said pallet to expose at least a side portion of said pallet beneath a lower edge of said guide, said exposed side portion being less than the width of said film; and c) then wrapping a loop of the film about an exposed side portion of said pallet so that the film engages exterior portions of said pallet and said guide so that forces that would otherwise be exerted upon said first layer of products are substantially fully transferred to said pallet and said guide.

2. The method of claim 1 further comprising:

d) depositing a second array of products upon said first layer to form a second layer on said pallet;

e) then moving said pallet by said given distance to expose at least a further portion of said pallet, and depending upon the height of an array of products on said pallet, a portion of the first layer of products, and causing the portion of the film looped around the guide to move away from said guide; and f) then wrapping a second loop of said film about a lower portion of said guide and a portion of the first loop of film so that the second loop engages exterior portions of said first loop and said guide, causing forces which would otherwise be exerted upon said products are substantially transferred to said first loop of film and said guide.

3. The method of claim 1 further comprising:

d) providing said guide with low friction external surfaces to facilitate separation of film looped about the guide from the guide.

4. A method for securing products deposited upon a pallet having a perimeter of a given shape, with a film derived from a supply roll, said film having a given width, comprising the steps of:

a) placing an array of products upon a top surface of said pallet to form a first layer of products on said pallet;

b) moving the pallet a given distance to pass said first layer into a hollow guide having a shape substantially conforming to the shape of the perimeter of said pallet to expose at least a side portion of said pallet beneath a lower edge of said guide, said exposed side portion being less than the width of said film;

c) wrapping a loop of the film about an exposed side portion of said pallet so that the film engages exterior portions of said pallet and said guide so that forces that would otherwise be exerted upon said layer of products are substantially fully transferred to said pallet and said guide; and d) providing said guide with external surfaces that are inclined inwardly to facilitate separation of film looped about the guide from the guide.

5. The method of claim 1 further comprising:

d) creating a film of air between engaging surfaces of said guide and film looped about said guide as said pallet is moved downwardly, to facilitate separation of said film from said guide.

6. The method of claim 1 further comprising:

(d) providing openings in external surfaces of said guide and passing air under pressure through said openings as said pallet is being moved downwardly to facilitate separation of said film from said guide.

7. Apparatus for wrapping film about products stacked upon a pallet for supporting said products in a loading/wrapping station, comprising:

an elevator for receiving and supporting said pallet;

a hollow guide through which an array of said products pass, for retaining products passing therethrough for deposit upon said pallet within a perimeter of said guide;

a supply roll of said film;

said supply roll being movable along a circular path;

a supply roll drive for moving said supply roll along said circular path;

said supply roll being positioned relative to said guide so that an upper portion of the film engages an exterior surface portion of said guide when the film is dispensed from said supply roll;

said elevator lifting a pallet to a product receiving position;

a transfer device for depositing a first array of products upon said pallet in the product receiving position;

said supply roll drive being activated responsive to deposit of said first array of products upon said pallet to move said film along said path, said film having a width sufficient to engage exterior surfaces of said pallet and said guide so that wrapping forces created by said film are applied principally to said guide and said pallet to prevent displacement of said first array of products on said pallet; and said elevator lowering said pallet in readiness to receive another layer of products whereby a loop of film engaging said guide moves downwardly along said guide.

8. Apparatus for wrapping film about products stacked upon a pallet in a loading/wrapping station, comprising:

an elevator for receiving and supporting a pallet;

a hollow guide through which an array of said products pass, for retaining products passing therethrough for deposit upon a pallet within a perimeter of said guide;

a supply roll of said film;

said supply roll being movable along a circular path;

a supply roll drive for moving said supply roll;

said supply roll being positioned relative to said guide so that an upper portion of the film engages an exterior surface portion of said guide when the film is dispensed from said supply roll;

said elevator lifting a pallet to a product receiving position;

a transfer device for depositing an array of products upon a pallet in the product receiving position;

said supply roll drive being activated responsive to deposit of an array of products upon said pallet to dispense said film, which has a width sufficient to engage exterior surfaces of said pallet and said guide so that wrapping forces created by said film are applied principally to said guide and said pallet to prevent displacement of said array of products on said pallet;

said elevator lowering said pallet in readiness to receive another layer of products whereby a loop of film engaging said guide moves downwardly along said guide; and tapering exterior surfaces of said guide to facilitate separation of film looped about said guide as the elevator is lowered.

9. The apparatus of claim 7 further comprising a device for introducing air between engaging surfaces of said guide and film wrapped around said guide to facilitate separation of said film from said guide.

10. The apparatus of claim 9 further comprising providing openings in said guide for passing said air through said openings and toward film wrapped about said guide.

11. The apparatus of claim 10 wherein said openings are concentrated at corners of said guide.

12. The apparatus of claim 10 wherein said openings are arranged in vertical columns at corners of said guide.

13. The apparatus of claim 12 wherein said corners are curved convex corners.

14. A method for loading and wrapping bundles on pallets, comprising:

successively moving arrays of products adjacent to a movable transfer plate;

then successively pushing at least two of said arrays on to the transfer plate arranged at a start position to form a first composite array;

then moving the transfer plate from the start position to a second position above a guide arranged at a pallet loading station;

then sweeping the first composite array off the transfer plate as it is moved to the start position to pass said first composite array downward through said guide to deposit said first composite array upon a pallet lifted to an upper position;

then wrapping a film about the pallet and the guide so that the film engages outer sides of said pallet and said guide to divert most of the forces exerted by the film away from said first composite,array to prevent the first composite array from being displaced on said pallet; and then lowering the pallet as the film is being wrapped about the pallet and the guide in readiness to receive the next group of arrays to be delivered by the transfer plate.

15. The method of claim 14 further comprising:

delivering air between portions of said guide and film wrapped about said guide to enable the film to move away from said guide as the pallet is lowered.

16. The method of claim 15 wherein said guide has a perpendicular shape and the air is delivered to corner regions of said guide.

17. The method of claim 14 wherein the film is stretched as it is wrapped about the guide and the pallet.

18. The method of claim 14 further comprising:

lowering the pallet to a start position when the loading and wrapping of the pallet is completed;

moving the loaded pallet away from the start position; and moving another pallet from a supply location to said start position in readiness for a subsequent loading and wrapping operation.

19. The apparatus of claim 7 wherein the guide is comprised of four sides, each side being perpendicular to two adjacent sides, ends of each of said four sides being displaced from ends of two adjacent sides.

20. The apparatus of claim 7 further comprising:

a stack of pallets;

means for lifting all but a pallet at a bottom of the stack; and means for delivering the pallet at the bottom of the stack to a starting location responsive to the means for lifting.

21. The apparatus of claim 20 further comprising:

means for moving a loaded pallet off of said elevator when the elevator is lowered to a start position to enable movement of an empty pallet onto said elevator by said means for delivering a pallet.

* * * * *